US005658638A

United States Patent [19]

Pottenger

[11] Patent Number: 5,658,638

[45] Date of Patent: Aug. 19, 1997

[54] INSERT CARD PACKAGING METHOD

[75] Inventor: Charles G. Pottenger, Macomb, Mich.

[73] Assignee: Hurletron Incorporated, Danville, Ill.

[21] Appl. No.: 529,629

[22] Filed: Sep. 18, 1995

[51] Int. Cl.[6] ..... B32B 3/04

[52] U.S. Cl. ..... 428/126; 428/130

[58] Field of Search ..... 428/130, 126, 428/121

[56] References Cited

U.S. PATENT DOCUMENTS

| | | | |
|---|---|---|---|
| 2,170,540 | 8/1939 | Steiner | 206/57 |
| 3,150,874 | 9/1964 | Zinke | 271/86 |
| 3,631,972 | 1/1972 | Gendron et al. | 206/57 R |
| 4,256,248 | 3/1981 | Lapp et al. | 226/118 |
| 4,458,814 | 7/1984 | Meschi | 206/494 |
| 5,085,624 | 2/1992 | Felix | 493/413 |
| 5,154,036 | 10/1992 | Focke et al. | 53/396 |
| 5,279,536 | 1/1994 | Abrey | 493/23 |

*Primary Examiner*—Alexander Thomas

*Attorney, Agent, or Firm*—Marshall, O'Toole, Gerstein, Murray & Borun

[57] ABSTRACT

A fan folded product and method for packaging preprinted fan folded cards or other material for attachment and for continuous feeding to a distribution machine. The cards are packaged in a series of rows having multiple stacks of cards in each row. The cards are pre-spliced together between adjacent rows to provide continuous folding of the cards. Alternate rows of cards are reversed fan folded and then packaged so that bottommost cards feed up the side wall of each stack in the opposite direction as the adjacent rows to provide continuous feeding in a serpentine manner of the cards to the distribution machine.

8 Claims, 3 Drawing Sheets

INSERT CARD PACKAGING METHOD

FIELD OF THE INVENTION

The invention is a method for packaging preprinted fan folded cards or other material for continuous feeding to a distribution machine.

BACKGROUND OF THE INVENTION

Preprinted fan folded continuous feed cards have been packaged for over 20 years in cartons that contain 15,000 to 16,000 cards. A typical use for these cards is for insertion into magazines and newspapers as advertisements or order forms. The cartons are currently sent to the application or distribution customer on skids or pallets. Within each carton the cards are packaged in stacks that may be connected in series to an adjacent stack within the same carton. These stacks are handled at the distribution site by an employee of the customer.

The current procedure to feed the preprinted cards into the distribution machine requires a considerable amount of attendance time as well as physical strength. The process requires that the cartons be moved manually from the skids to the floor and placed in line with the distribution machine. The stacks of cards are generally packaged in cartons weighing approximately 60 pounds when filled. In addition, the employee must be constantly available to splice ends of the last card in a stack to a first card in another stack or carton to ensure the continuous feeding of the fan folded cards. This procedure creates additional handling and manning of the process by the application customer; and creates additional manning in labor at the packaging facility.

Recent prior art in the area of handling of fan folded material generally dealt with the handling of continuous fan folded computer paper to and from a printer. For example, U.S. Pat. No. 5,279,536 discloses a conveyor with spaced apart paper stacking regions for the handling of the computer paper discharged from the printer. This patent is not applicable for the packaging of preprinted fan folded cards for a distribution machine. In the same line, U.S. Pat. No. 4,458,814 discloses a packaging assembly for sheet material utilized to feed printing machines, where the fan folded computer paper is packaged such that the bottom sheets are placed sideways and perpendicularly to the sheet package lie plane. This configuration allows the bottom sheets to be picked up for splicing. This patent provides a means for packaging a series of stacks in a single row, but is not applicable for packaging of hundreds of thousands of cards in multiple rows for feeding in a continuous manner to a delivery distribution site.

SUMMARY OF THE INVENTION

The object of the invention is to address the concerns mentioned above. Although the invention is explained hereinafter as a card packaging process, the invention is adaptable for such material as preprinted labels, envelopes, fragrance strips, or other preprinted, fan folded material used for attachment and particularly material having file hole punches along one side of the material.

It is the desire of the invention to store a number of rows of preprinted stacked cards on a pallet or skid, so that the whole pallet may be delivered to a customer at its appropriate site and therefore, eliminate the manual delivery of a single row of stacked cards to the distribution machine. As a result, manual delivery of a single row of stacked cards is eliminated. It is the intent of this process to provide a package containing approximately 400,000 cards for delivery to the distribution machine in one delivery, rather than multiple deliveries in increments of 15,000 to 16,000 cards as done in the prior art.

The invention is an insert card packaging process which includes storing stacks of continuous fan folded cards in rows so that the cards may automatically be retrieved from one stack to another. Once one row of stacked cards have been fed into the distribution machine, the card packaging method automatically continues to feed from the second row of cards. The cards are packaged in an orientation that allows them to feed consistently with the preprinted matter facing the same direction so that the cards will be inserted at the distribution site in accordance with the specific needs of a project. The packaging method includes stacking a row of cards that are continuously connected. Once the first row is completed, the second row of cards is then started and spliced to the first row. On occasions where the material is an expensive card line and waste must be kept at a minimum; in order to provide a consistent feeding of the cards from the first to second row so that no unnatural bend of the cards is formed that may jam the machinery, the cards making up the second row and every alternate subsequent row are offset fan folded by advancing the fold in the cards the equivalent of one full card width during the printing and folding process. This process is referred to as reverse fan folding. After the printing and reverse fan folding of the cards is completed, the entire completed row of reverse fan folded cards that will be used to make up the second row are turned 180° relative to the first row, before packaging into stacks. If the card line is not composed of expensive material, the process of reverse fan folding can be deleted for the second and alternate subsequent rows. To facilitate the proper feeding from the first row to the second row, the cards are spliced together such that the trailing card from the first row is twisted one-half turn when spliced so that the beginning card of the second row will then feed in the proper manner that is consistent for the distribution operations that follow. Subsequent odd number rows will be formed as described for the first row; and even number rows will be formed as described for the second row.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 5:
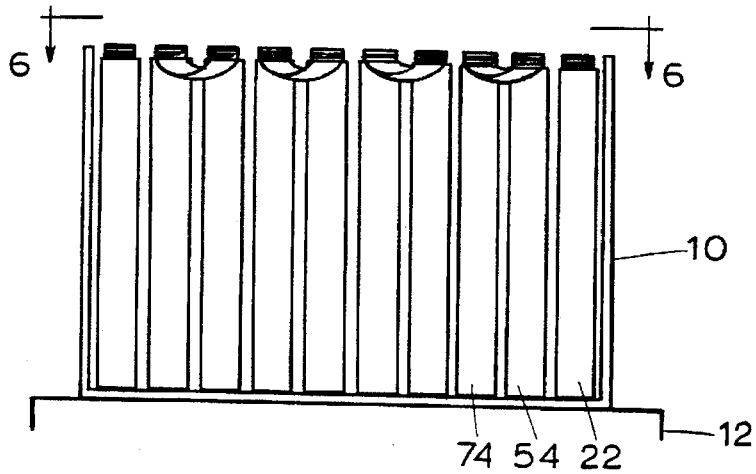
FIG. 5 is a schematic showing a plurality of stacked rows on a pallet.
Figure 6:
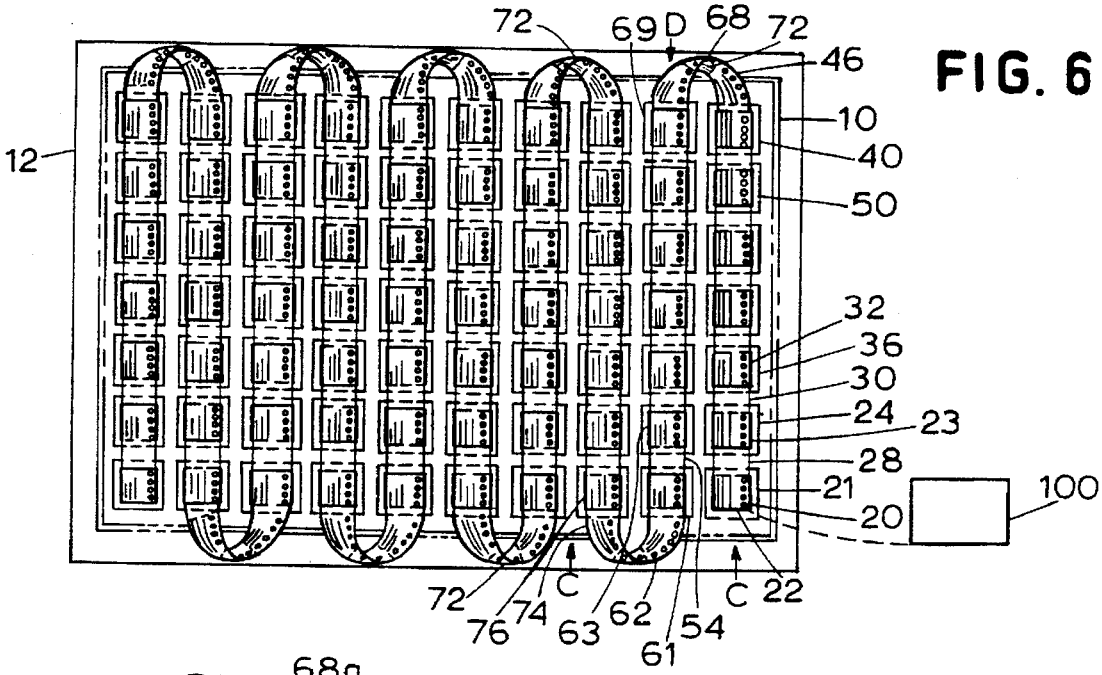
FIG. 6 is a schematic showing a top view of the stacked rows of cards of FIG. 5 taken along lines 6—6.

Looking first at FIGS. 5 and 6, the invention provides a method for providing a continuous flow of preprinted Z-folded or fan folded cards or similar material having file hole punches thereon to a processing or distribution machine (not shown) wherein rows of stacked cards are placed in a container 10 on a pallet 12 such that the entire pallet 12 can be positioned one time adjacent the processing machine for feeding into the machine. The cards are aligned and stacked in the container in such a manner so that the processing machine 100 can be fed approximately 400,000 cards automatically and continuously thereby eliminating extra manpower at the processing machine for carrying and splicing continuous stacks and rows of cards. The number of cards or similar material that can be continuously fed to the processing machine 100 is not limited to 400,000, but is determined by the size of the material and the size and number of the pallets 12.

The top card 20 from the first stack or column 21 of the first row 22 is fed into the processing machine. The bottom card 28 of the first stack 21 is interconnected to the top card 23 of the second stack or column 24. The bottom card 30 of the second stack 24 is interconnected to the top card 32 of the third stack 36 and so on to complete the first row 22 of sequential and interconnected stacks. The subsequent rows of stacked cards must be packaged in a certain manner to continuously feed the cards in the same alignment as the first row. The cards between adjacent rows must also be spliced together in a certain manner to prevent bending of the cards or needless waste. The stacking and splicing process will be discussed hereinafter.

Figure 1A:
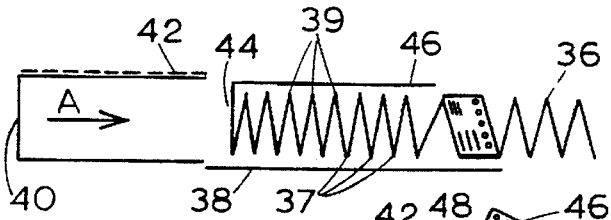
FIG. 1*a* is a schematic showing the first process step for stacking the first row of cards.
Figure 1B:
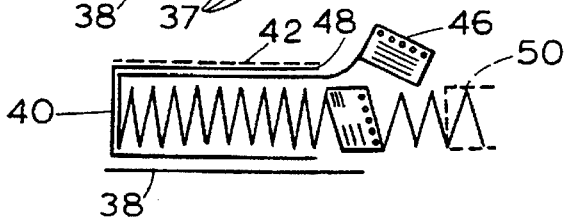
FIG. 1*b* is a schematic showing the second process step for stacking the first row of cards.
Figure 1C:
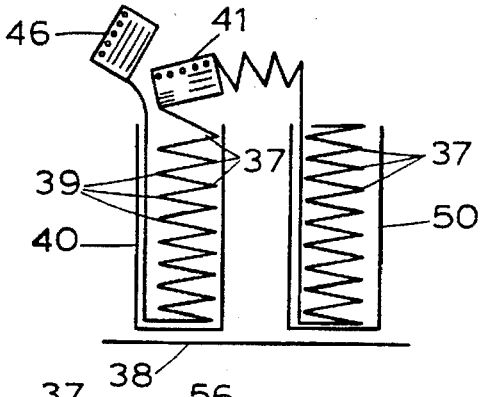
FIG. 1*c* is a schematic showing the third process step for stacking the first row of cards.

FIGS. 1*a* through 1*c* indicate the process steps for packaging the stacks for the odd number rows. FIG. 2*a* through 2*d* represent the process steps for packaging the even number rows. It would be obvious to persons skilled in the art that the processing for the odd and even rows may be reversed, so that the steps as shown in FIGS. 2*a* through 2*d* may be used for the odd number rows and the steps shown in FIGS. 1*a* through 1*c* may be used for the even number rows. It is only important that the alternate stacking process is used for the adjacent rows.

Looking first at FIGS. 1*a* through 1*c*, a body 36 of fan folded cards have already been printed and folded in the conventional manner and are generally positioned on a table 38 for boxing and packaging to be sent to the distribution customer. The box 36 of fan folded cards are positioned such that a folded edge 37 of the cards is against the table 38; and so that a first edge, defined as the edge having file hole punches 58 is positioned either on the right side or left side as predetermined by the application. A box 40 having one side an open flap 42 (indicated by dashed line) will be fed to one end designated as the bottom 44 of the body 36 of cards as shown by the arrow A. The bottom cards 46 will be fed along the side of the body 36 of cards so that a number of the bottom cards 46 will be exposed at the top 48 of box 40 when the box is fully in place as a stack as shown in FIG. 1*b*. In other words, the bottom cards 46 will be fed along the opposite edge 39 from the edge 37 against the table 38.

Each box is approximately 4 feet high and will only house a portion of the original body 36 of cards from the printer machine to form a stack. Once each box 40 is filled and the bottommost cards 46 are fed to the top 48 of the box, the open flap 42 can be closed and sealed to secure the cards within the box. Then box 40 is uprighted as shown in FIG. 1*c*. A second box 50 and subsequent boxes will follow the same process as the first box 40 to stack the cards while forming the first row 22. The top card 41 of box 40 is connected to the bottommost cards of second box 50, as shown in FIG. 1*c*. As the body 36 of cards are being boxed to form stacks, the stacks will be positioned adjacent to each other to form a row as shown in FIG. 6. The first box 40 packaged of the first row 22 will be the last stack of the first row 22 that will be fed into the distribution machine at the application site. Stack 21 which is the first stack of first row 22 to be fed into the processing machine 100 was the last stack from body 36 of cards to be boxed. As a result, the bottommost card 46 of the first box 40 will be the card that must be spliced to the top card 68 of the second row 54 as will be discussed further hereinafter. Therefore, looking at FIG. 6, box 40 was the first box packaged from the body of cards 36 and corresponds to box 40 in FIG. 1*a*.

Figure 2A:
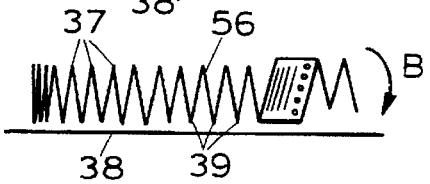
FIG. 2*a* is a schematic showing the first process step for stacking the second row of cards.
Figure 2B:
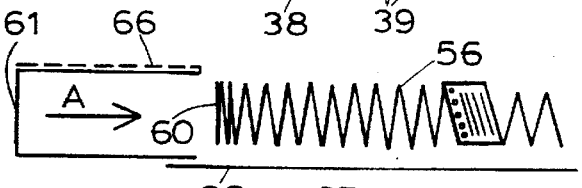
FIG. 2*b* is a schematic showing the second process step for stacking the second row of cards.
Figure 2C:
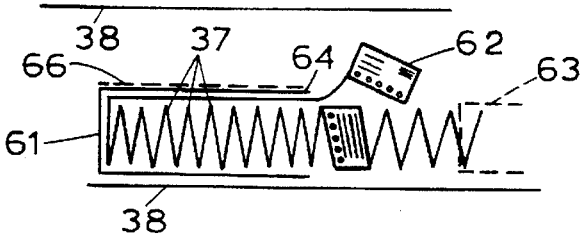
FIG. 2*c* is a schematic showing the third process step for stacking the second row of cards.
Figure 2D:
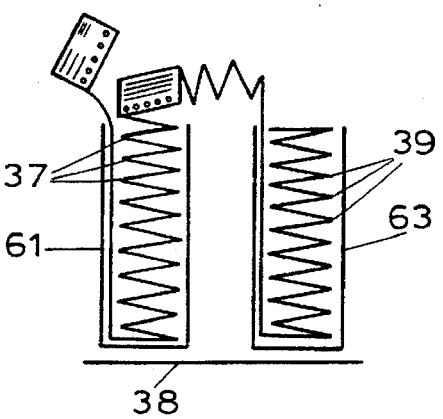
FIG. 2*d* is a schematic showing the fourth process step for stacking the second row of cards.

FIGS. 2*a* through 2*d* show the steps for the next adjacent row or even row of stacked and boxed cards. In order to provide a continuous flow of cards to the distribution machine such that the fan fold of cards are consistently the same as the cards are run through the distribution machine, and so that a minimum of cards are scrapped to prevent waste, the next body 56 of cards are reverse fan folded. The reverse fan folded procedure includes having the body 56 of cards fan folded in the printing machine at an offset from the original body of cards, by one card width. For example, a typical business reply mail card is 5½ inches wide. Therefore, the printing and folding machine is offset for folding by 5½ inches, as shown in FIG. 2*a*. For other material having other widths, the folding offset will be adjusted accordingly. The reverse fan folded procedure is not required, but provides the advantage of saving material, as discussed further.

Figure 3:
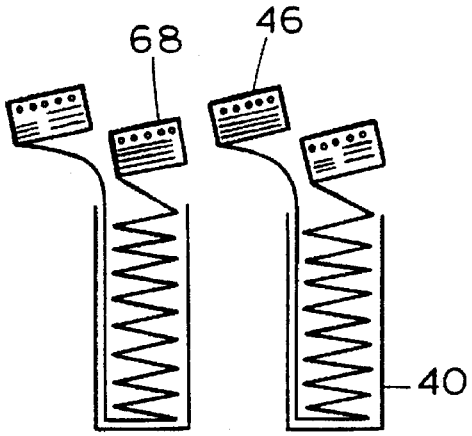
FIG. 3 shows a first row of cards adjacent to a second row of cards.

The body 56 of cards are positioned on the table 38 similarly as done for body 36 of cards in FIGS. 1*a* and 1*b* with edges 37 of the body against the table 38. The body 56 of cards are then turned 180°, as signified by arrow B, so that the file hole punches 58 are positioned 180° relative to the file hole punches 58 as shown in FIG. 1*a* and edges 39 are against the table 38. In other words, if the file hole punches 58 were to the right of the body 36 of cards when boxing the first row 22, the body of cards 56 for the second row 54 is turned so that the file hole punches 58 are to the left. A box 61 having open flap 66 is again fed to one end designated as the bottom 60 of the body 56 of cards and a portion of the bottom cards 62 is threaded up the side of box 61 so that the bottommost card 62 is exposed at the top 64 of the box 61. Once the cards have been turned 180° as shown in FIG. 2*a* to 2*b*, the boxes 61, 63 etc. are filled with the cards in a similar fashion as done in FIG. 1*a* and 1*b*, wherein the open flap 66 is closed and sealed to secure the stack of cards. The purpose of the 180° turn of the body 56 of cards is to redirect the direction of the bottommost cards 62 when they are fed along the side of the box 61 to be exposed at the top of the box 61. As can be seen in FIG. 6, the first row 22 feeds the cards into the distribution machine in the direction of arrow C. In the second row 54, the cards are fed into the distribution machine sequentially in the opposite direction as shown by arrow D. The bottommost cards of each stack in the second row 54 must face the adjacent stack in the same row in the opposite direction than the direction of the bottommost cards of the first row 22, as shown in FIG. 3.

Figure 7:
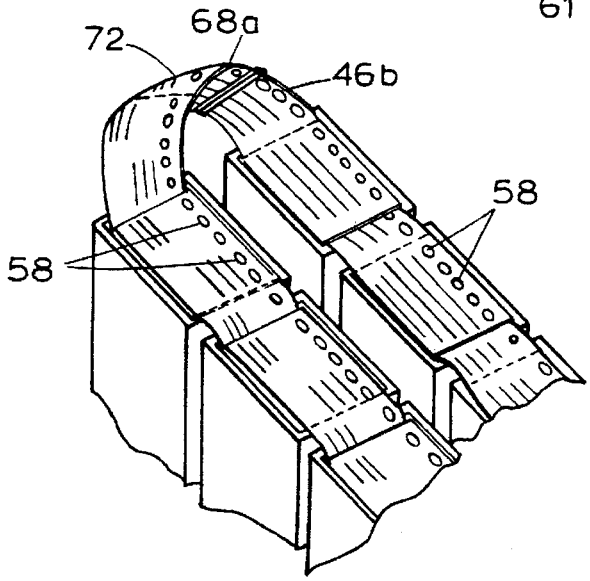
FIG. 7 is a schematic showing the spliced connection between adjacent stacked rows.

Further, to continue the smooth feed transition from one row of cards to the next row, when the first stack of cards of the second row 54 is boxed; box 61 must be aligned next to the last stacked box 21 of the first row 22 (see FIG. 6) so that the file hole punches 58 are facing the same direction, as shown in FIGS. 6 and 7. This generally requires that the box 61, once uprighted, must be turned so that the direction of the file hole punches 58 coincide to the direction in the first row 22. The last portion of body 56 of cards to be stacked in box 69 will have card 68 on top for splicing to the first row. As can be seen in FIG. 6, the stacks of cards are positioned successively in a serpentine fashion.

It can be viewed by FIG. 6 that the packaging of the fan folded cards can also be accomplished by eliminating the second row 54 packaging procedure as described with reference to FIGS. 2A through FIG. 2D. The last card 46 from first row 22 would then be connected to top card 76 of third row 74. Third row 74 is formed in the same manner as the fan folded row 22, as shown in FIG. 1A through FIG. 1C. As a result of eliminating the packaging of second row 54, a portion of the fan folded cards would extend from one side of carton 10 to the opposite side of carton 10 to form a serpentine over some of the boxed stacks in the first row 22. The portion of cards extending over the boxed stacks of the first row would possibly interfere with the processing of the cards. Therefore, it is preferred to stack the fan folded cards having alternating rows, wherein the direction of the processing of the cards changes between adjacent rows.

Figure 4A:
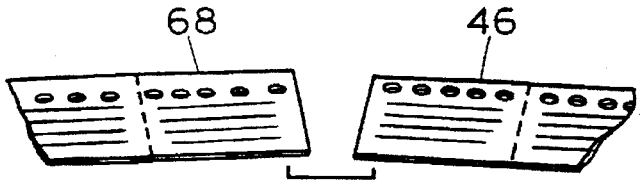
FIG. 4*a* is a schematic showing the first process step for splicing the last card of the first row with the first card of the second row.
Figure 4B:
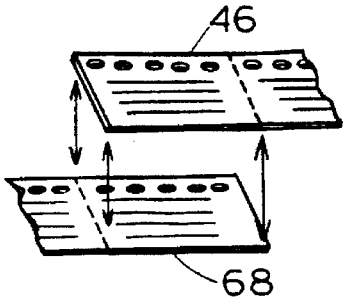
FIG. 4*b* is a schematic showing the second process step for the splicing process as described in FIG. 4*a;*
Figure 4C:
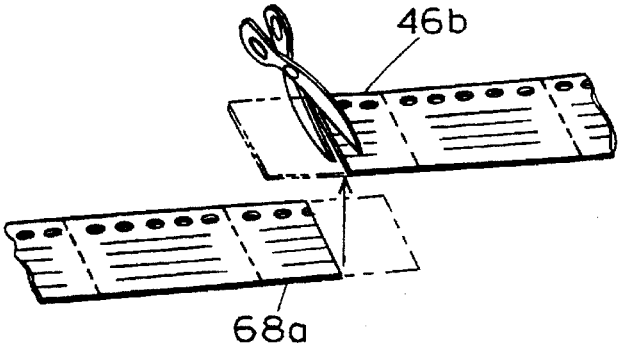
FIG. 4*c* is a schematic showing the third process step for the splicing process.
Figure 4D:
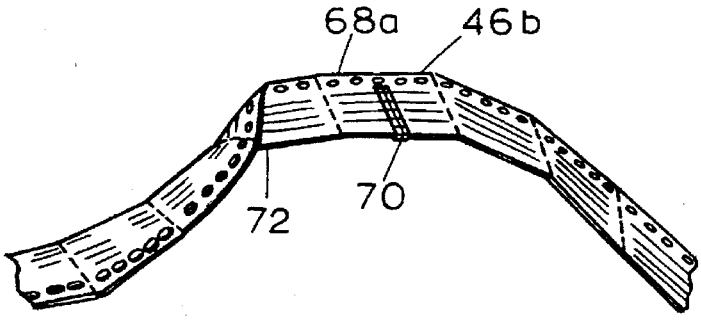
FIG. 4*d* is a schematic showing the last card of the first row spliced to the first card of the second row.

FIGS. 4*a* through 4*d* indicate the process steps for splicing the last card of one row to the first card of the adjacent row in the preferred embodiment. The first box packaged for each row will be the last box fed to the machine per row. The first box packaged for each row will also have its bottommost card spliced to the adjacent top card of the next row. For example purposes, the last card of the first row 22 from the first stacked box 40 is card 46 (FIG. 4*a*). The first card from second row 54 to be fed to the machine is card 68 (FIG. 4*a*). The first 68 and the last cards 46 of the adjacent rows are placed on top of each other to align the file hole punches 58, as shown in FIG. 4*b*. The double cards are cut essentially down the middle as in FIG. 4*c*. And each half card 68*a*, 46*b* still connected to the series of cards is taped 70 or otherwise attached to the other half card that remains attached to its stack of cards. When taping the two half cards together, it is essential that the file hole punches 58 remain open. Looking at both FIGS. 4*d* and 7, the resulting connection between the two adjacent rows requires a half twist 72 between the half cards in order to align the file hole punches 58 and to align the indicia side of the card of one row with the indicia side of the card of the adjacent row. The half twist 72 of the cards as a result of splicing the two rows together is an important aspect in order to provide a smooth continuous feeding of the cards from row to row. Without the half twist, the cards will have a tendency to bend and tear which may result in jamming of the distribution machine. The reverse fan folding as discussed earlier and shown in FIG. 2*a* has the advantage of maintaining the Z-fold configuration as shown in FIG. 4*a* when the two end cards 68, 46 are joined together. As a result of reverse fan folding, as shown in FIG. 4*c*, only one-half of the first card and one-half of the second card is wasted when the rows are spliced together. If reverse fan folding does not occur for alternate rows, generally one full card plus the one-half of cards of the first and last cards of the row are wasted. Maintaining the continuous Z-formed fan folding results in a smoother delivery to the distribution machine.

As a result of this process for stacking and splicing rows of cards, the boxed cards may be packaged in one container or crate 10 set on a pallet 12 and then delivered directly to the application customer. The application customer then needs only to forklift the pallet containing the crated boxes to the distribution machine a single time for the processing of approximately 400,000 cards without any splicing. Although FIG. 6 shows a crate 10 of cards having ten rows with seven stacks of cards in each row, the number of rows and stacks may vary depending upon the size of the preprinted, fan folded material. If it is desirable to splice cards or other material from one pallet 12 to another pallet then it is preferred that the crate 10 on the pallet contains an odd number of rows to help provide a smooth feed transition.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A preprinted fan folded material packaged by the method of:

forming a first row of a series of stacked and continuously connected material;

forming a second row of a series of stacked and continuously connected material adjacent the previous row;

forming subsequent odd rows of a series of stacked and continuously connected material in the same manner as the first row and placing said odd row adjacent the previously formed even row;

forming subsequent even rows of a series of stacked and continuously connected material in the same manner as the second row and placing said even row adjacent the previously formed odd row;

splicing material of adjacent rows for processing the material in a continuous and serpentine manner;

setting each stack of the first row upright in a predetermined order;

setting each stack of the second row upright in the opposite order, such that the first stack of the second row is adjacent the last stack of the first row and the last stack of the second row is adjacent the first stack of the first row; and setting each subsequent stack of a row upright in the opposite order of the preceding row, said preprinted fan folded material comprising: a predetermined number of adjacent rows of stacked material; each row having a predetermined number of stacks of continuously connected material wherein material from each row is spliced to material in an adjacent row for processing in a serpentine manner.

2. The preprinted fan folded material of claim 1 wherein said material has file hole punches along a longitudinal side of the material.

3. A preprinted fan folded material comprising:

an elongated continuous strip of material having a plurality of transversely extending folds spaced longitudinally from one another and fan folded such that portions of the continuous strip form at least two stacks; and means defined by another portion of the continuous strip extending between a first end of the first stack and a second end of the second stack such that the continuous strip is twisted 180° about its longitudinal axis in a rotational direction.

4. The preprinted fan folded material of claim 3 wherein said 180° twist permits reorientation of the second stack with respect to the first stack such that a feed path of the continuous strip passes through a 180° rotational reversal of direction.

5. The preprinted fan folded material of claim 4, wherein the rotational reversal of direction is in the same rotational direction as the rotational twist.

6. The preprinted fan folded material of claim 5, wherein each fold is perforated defining an individual discreet member therebetween and said perforations define a trailing edge of one member and a leading edge of the immediately adjacent downstream member.

7. The preprinted fan folded material of claim 6 further having a first side edge and a second side edge extending longitudinally along the continuous strip, wherein said first stack and said second stack are positioned such that the first edge of the first stack is adjacent the second edge of the second stack.

8. The preprinted fan folded material of claim 7, wherein the first stack defines an end of a row of plurality of stacks and having means for connecting said plurality of stacks of said row, and the second stack defines a beginning of another row of plurality of stacks and having means for connecting said plurality of stacks of said other row.

* * * * *